United States Patent [19]

Epstein

[11] 4,031,576

[45] June 28, 1977

[54] INVALID TOILET AID

[76] Inventor: Helen Charlotte Epstein, 1193 S. 19th East, Salt Lake City, Utah 84108

[22] Filed: May 24, 1976

[21] Appl. No.: 689,550

[52] U.S. Cl. ..... 4/251; 4/185 L; 4/254; 297/DIG. 10

[51] Int. Cl.² ..... A47K 13/10

[58] Field of Search ..... 4/185 R, 185 L, 251, 4/237, 254; 297/DIG. 10, 314; 5/81 R

[56] References Cited

UNITED STATES PATENTS

| | | | |
|---|---|---|---|
| 3,317,928 | 5/1967 | Root | 4/185 L |
| 3,458,872 | 8/1969 | Hellstrom et al. | 4/237 |
| 3,473,174 | 10/1969 | Cool | 4/251 |
| 3,640,566 | 2/1972 | Hodge | 297/DIG. 10 |
| 3,714,672 | 2/1973 | Condon | 4/185 L |
| 3,925,833 | 12/1975 | Hunter | 4/251 |

*Primary Examiner*—Robert I. Smith

*Attorney, Agent, or Firm*—Robert D. Farkas

[57] ABSTRACT

This disclosure pertains to an aid for invalids facilitating their ability to be seated and unseated from a water closet utilizing a pair of horizontally disposed arm rests and a hinged commode seat whose elevation and angular position above the water closet is under the manual control of the invalid. A manually operated lever enables a spring to bias the arm rests and the seat in an uppermost position for use by the invalid in the standing position. Manipulating the lever permits the arm rests to descend and the seat to assume a horizontal position with the spring resisting the downward forces exerted on the arm rests and the seat, by the user, as he is gently lowered into a seated position. Re-manipulation of the lever causes the spring to urge th arm rests in an upward position, and the seat to assume a near vertical position thereby aiding the invalid to achieve a standing posture.

8 Claims, 3 Drawing Figures

INVALID TOILET AID

BACKGROUND OF THE INVENTION

1. The Field of the Invention

This invention relates to invalid aiding apparatus and more particularly to that class facilitating an invalid's use of a commode.

2. Description of the Prior Art

The prior art abounds with devices facilitating convenient use of commodes by invalids. U.S. Pat. No. 3,473,174 issued on Oct. 21, 1969 to G. E. Cool and U.S. Pat. No. 3,458,872 issued on Aug. 5, 1969 to N. E. Hellstrom et al both teach an hydraulically powered apparatus functioning as an aid to users of commodes by providing powered assistance in achieving a sitting or standing position. Both of the aforementioned patents utilize hydraulically operated cylinders resulting in high initial costs of acquisition and expensive maintenance requirements.

SUMMARY OF THE INVENTION

A primary object of the present invention is to provide an arm rest support for an invalid permitting variable height arm support whilst being seated or rising from a commode.

Another object of the present invention is to provide a commode seating apparatus that does not require outside power services in the operation thereof.

Still another object of the present invention is to provide a portable device which can be readily installed on the floor adjacent existing commodes.

Yet another object of the present invention is to provide an inexpensive apparatus which supplies a back rest which moves in unison with the arm rest portions thereof.

A further object of the present invention is to provide a commode seating aid which may be fully and effectively controlled by the invalid utilizing only hand motions therefor.

Another object of the present invention is to provide a hingeable seat portion, which works in unison with arm rest portion, further supporting portions of the user's body in the vertical position, the seated position, and in the intermediate positions thereof.

Patients in hospitals and in nursing homes, as well as those at home, often require assistance in achieving a seated position on a commode from an inital standing position thereabove as well as achieving an upright standing position after being seated on the commode. These patients include stroke victims, leg amputees, those disabled by atrophied or otherwise malfunctioning back muscles, patients who do not have viable knee function, and the otherwise infirm. The instant invention utilizes a pair of spaced apart, horizontally disposed supporting arms extending outwardly from a substantially vertically disposed backrest. The arms and the backrest are permitted to be lowered and raised when positioned on each side and to the rear of a commode, utilizing a support frame therefor. The patient obtains support by resting his arms on the arm rests during periods in which he is lowered towards or raised from the commode. A lever permits an arm brace to utilize a spring to raise the supporting arms in an uppermost position. The same lever, when manipulated in the opposite direction, causes the spring to resist a downward motion of the support arms and backrest elements. The frame is equipped with forwardly extending legs which rest on the floor athwart the commode thereby providing stability to the frame at all times. A hingeable seat is pivotably affixed at the rearward end thereof to the backrest portion of the apparatus. The frontmost portion of the seat pivots downwardly and rearwardly when the arm rests are in the uppermost position, and upwardly and forwardly when the arm rests are in the lowermost use position.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a stationary frame which is placed on the floor adjacent the commode so as to have the horizontal leg portions thereof extend athwart the commode base. A portion of the frame extends upwardly over the rearmost portions of the commode. A pair of slots in the vertical portion of the frame provide a sliding support for a backrest panel, whose vertical plane extends upwardly and forwardly of the vertical portion of the frame. A pair of horizontally disposed support arms extend vertically forward, in spaced apart relationship, from the sides of the backrest portion. The seat of the commode has the rearmost portions thereof hingeably affixed to the bottom horizontal edge of the back supporting panel. One end of a brace element is hingeably affixed to the frame near the intersection of the vertical portions and the legs thereof. The other end of the brace is pivotably affixed adjacent the front-most edge of the commode seat. A spring is secured to the brace and to the commode seat. A lever arm is pivotably affixed along the same pivot axis as the pivot axis hingeably connecting the commode seat and the brace. When the user operates the lever into an outward direction, the frontward edge of the commode seat is urged in a downward forward direction, resisted by the spring. Simultaneously, the spring resists a downward motion of the arm rests and backrest. The forces exerted by the spring are overcome by the user allowing, ultimately, the commode seat to reach a horizontal position whilst the arm rests and back rest finally achieve a lowermost commode use position. The user may then urge the lever backwardly causing the brace and the commode seat to assume a near vertical position whilst the arm rests and backrest are translated into an uppermost position.

Figure 1:
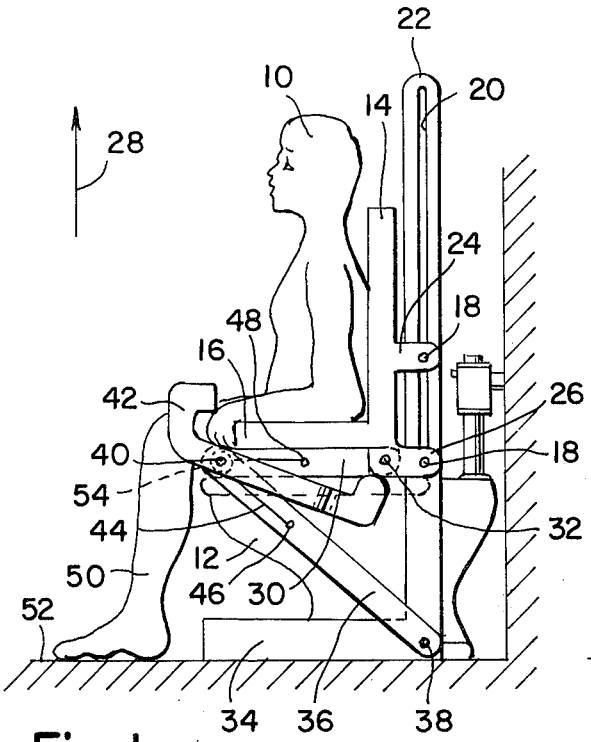
FIG. 1 is a side elevation view of the instant invention shown in the lowermost, commode use position.

Now referring to the Figures, and more particularly to the embodiment illustrated in FIG. 1 showing a user 10 seated at a commode 12. A backrest panel 14 and an arm rest 16 support the back and arms of the user 10. Pins 18, extending through slot 20 in a vertically disposed portion of frame 22, fasten to wings 24 and 26 affixed to the backrest 14. When pins 18 move in the direction of arrow 28, arm 16 and backrest 14 similarly extend vertically. Commode seat 30 is hingeably affixed about pivot rod 32 to the lowermost end of backrest 14. Leg 34 extends forwardly from vertical frame portion 22, residing on one side of commode 12. Brace 36 is pivoted around pivot rod 38 to frame 22. Pivot rod 40 pivotably secures the other end of brace 36 to commode seat 30, whilst providing a pivot axis for lever 42. Spring 44 is connected at one end, at point 46, to brace 36 and, after passing around pivot rod 40, is connected at the other end, at point 48, to commode seat 30.

Figure 2:
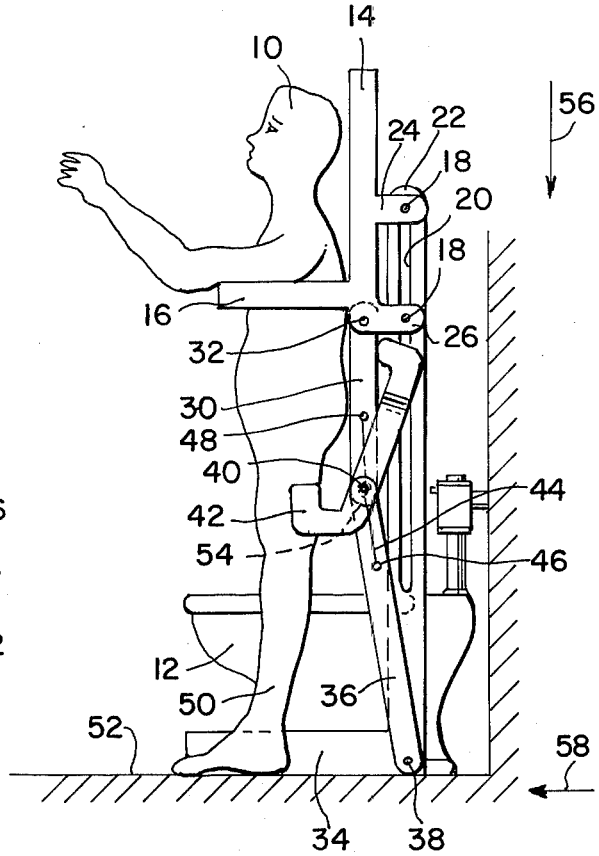
FIG. 2 is a side elevation view of the instant invention shown with its arm rest portions in the uppermost position.

FIG. 2 illustrates the user in an upright position obtaining support from backrest 14, arm rest 16, and commode seat 30, whilst gaining some support by resting legs 50 upon the floor 52, adjacent commode 12. Brace 36 is shown in the near vertical position as is commode seat 30. In the position shown, pivot rods 32, 40, and 38 are nearly vertically aligned due to the bias forces exerted by spring 44. Brackrest 14 and arm rest 16 are in the uppermost position. The front edge 54 of commode seat 30 will extend downwardly, in the direction of arrow 56, and forwardly, in the direction of arrow 58, when lever 42 is pulled forwardly in the direction of arrow 58 or downwardly in the direction of arrow 56.

Figure 3:
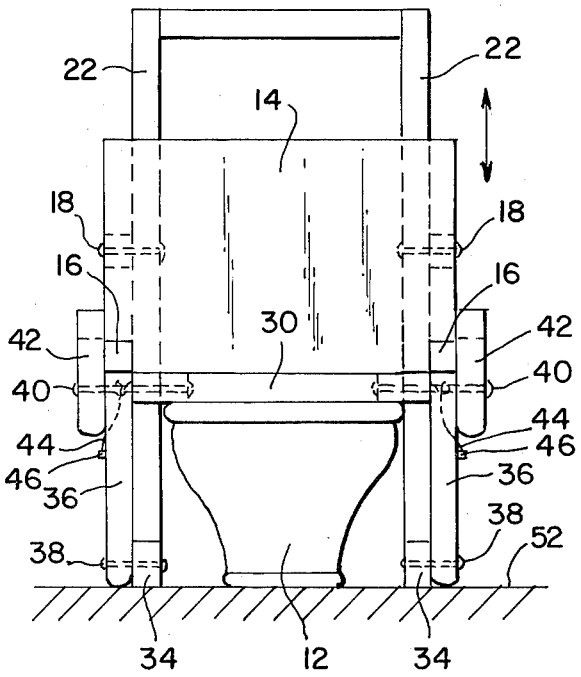
FIG. 3 is a front elevation view of the instant invention shown disposed in a lowermost position.

FIG. 3 illustrates backrest 14 disposed forwardly from frame 22 and over commode 12. Legs 34 are shown resting on floor 52 and supporting frame 22 thereby. Pivot rods 38 pivotably connect braces 36 to commode seat 30, utilizing pivot rods 40 therefor. Levers 42 pivotably connect to pivot rods 40. Springs 44 are illustrated, passing in part, about pivot rods 40. Pin 18 are shown slideably fastening backrest 14 to the rearmost vertical portion of frame 22. Arm rests 16 are shown in end view, projecting forwardly from backrest 14.

One of the advantages of the present invention is an arm rest support for an invalid permitting variable height arm support whilst being seated or rising from a commode.

Another advantage of the present invention is a commode seating apparatus that does not require outside power services in the operation thereof.

Still another advantage of the present invention is a portable device which can be readily installed on the floor adjacent existing commodes.

Yet another advantage of the present invention is an inexpensive apparatus which supplies a backrest which moves in unison with the arm rest portions thereof.

A further advantage of the present invention is a commode seating aid which may be fully and effectively controlled by the invalid utilizing only hand motions therefor.

A still further advantage of the present invention is a commode seating aid with a hingeable seat portion, which works in unison with arm rest portion, further supporting portions of the user's body in the vertical position, the seated position and in the intermediate positions thereof.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. An invalid toilet aid comprising a commode seat, a frame, a backrest, at least one arm rest, said at least one arm rest fixedly secured to said backrest, hingeing means for pivotably securing a rear portion of said commode seat to said backrest, spring bias means for urging said at least one arm rest into an uppermost position, said spring bias means for resisting said at least one arm rest being disposed in a lowermost position, said commode seat being disposed in a near vertical position when said at least one arm rest is disposed in said uppermost position, said commode seat being disposed in a horizontal position when said at least one arm rest is disposed in said lowermost position, said frame providing sliding vertical support for said backrest.

2. The invalid toilet aid as claimed in claim 1 further comprising legs, said legs providing lateral support for said frame.

3. The invalid toilet aid as claimed in claim 1 further comprising a brace, one end of said brace pivotably secured to said commode seat adjacent the frontmost portions thereof, the other end of said brace pivotably secured to said frame at a point below the lowermost portion of said commode seat when said commode seat is disposed in said horizontal position.

4. The invalid toilet aid as claimed in claim 3 wherein said spring bias means comprises a spring, one end of said spring fixedly secured to said brace intermediate said one end and said other end thereof, the other end of said spring fixedly secured to said commode seat intermediate said rear portion and said frontmost portions thereof.

5. The invalid toilet aid as claimed in claim 4 wherein said spring traverses around a pivot rod, said pivot rod for pivotably affixing said one end of said brace to said front-most portions of said commode seat.

6. The invalid toilet aid as claimed in claim 5 further comprising a lever, said lever pivotably secured to said pivot rod.

7. The invalid toilet aid as claimed in claim 1 wherein said backrest is fixedly secured to two arm rests, said two arm rests being disposed in spaced apart relationship and extending horizontally forwardly from said backrest.

8. The invalid toilet aid as claimed in claim 1 wherein said hingeing means comprises at least one pivot rod extending horizontally from said backrest, said at least one pivot rod pivotably engaging said rear portion of said commode seat to said backrest.

* * * * *